US012305948B1

(12) United States Patent
Wilson

(10) Patent No.: US 12,305,948 B1
(45) Date of Patent: May 20, 2025

(54) GRIP SIZE MEASURING TOOL

(71) Applicant: Robert Steven Wilson, Flagstaff, AZ (US)

(72) Inventor: Robert Steven Wilson, Flagstaff, AZ (US)

( * ) Notice: Subject to any disclaimer, the term of this patent is extended or adjusted under 35 U.S.C. 154(b) by 0 days.

(21) Appl. No.: 18/604,163

(22) Filed: Mar. 13, 2024

(51) Int. Cl.
*F41A 35/00* (2006.01)
*F41C 27/00* (2006.01)

(52) U.S. Cl.
CPC ..... *F41A 35/00* (2013.01); *F41C 27/00* (2013.01)

(58) Field of Classification Search
CPC ..... F41A 25/00; F41A 99/00; F41C 23/10; F41C 23/16; F41C 27/00
See application file for complete search history.

(56) References Cited

U.S. PATENT DOCUMENTS 1,494,407 A * 5/1924 Beach ..... F41A 33/00 42/106
4,630,387 A * 12/1986 Crane ..... F41C 23/10 42/71.02
6,804,907 B1 * 10/2004 Slobodkin ..... F41C 23/14 42/74
6,988,295 B2 * 1/2006 Tillim ..... A61B 17/3213 16/110.1
10,775,125 B1 * 9/2020 Owen, Jr. ..... F41A 33/00
12,222,185 B1 * 2/2025 Myer ..... F41C 23/10
2016/0202017 A1 * 7/2016 Corbet ..... F41C 23/14 42/71.01
2016/0341517 A1 * 11/2016 Williams ..... B33Y 50/00
2022/0265188 A1 * 8/2022 Faughn ..... F41C 27/00

* cited by examiner

*Primary Examiner* — Joshua E Freeman
(74) *Attorney, Agent, or Firm* — Plager Schack LLP; Mark H. Plager, Esq.; Michael J. O'Brien, Esq.

(57) ABSTRACT

A grip measurement tool is configured to aid a user in selecting a properly fitting firearm. The grip measurement tool has a barrel first half joined to a barrel second half. A multi-colored barrel gauge is mounted in the barrel first half and joined to an upper front grip with a front grip knob that slides in a front handle track. A front grip further includes a lower front grip joined to the upper front grip. The lower front grip further includes a plurality of front grip measurement markings. A rear handle is joined to the front grip with a pair of springs. A rear handle knob joins the rear handle to the barrel first half proximate a plurality of angle markings. The multi-colored barrel gauge, the plurality of front grip measurement markings, and the plurality of angle markings provide data to the user in selecting a properly fitting firearm.

6 Claims, 5 Drawing Sheets

GRIP SIZE MEASURING TOOL

BACKGROUND

The embodiments herein relate generally to firearms.

Proper fit of a firearm to a specific individual's hand size and natural point of aim is critical to safe and accurate operation of the firearm. Prior to embodiments of the disclosed invention, there was no efficient way to fit a firearm. Embodiments of the disclosed invention solve this problem.

SUMMARY

A grip measurement tool is configured to aid a user in selecting a properly fitting firearm. The grip measurement tool has a barrel first half joined to a barrel second half. A multi-colored barrel gauge is mounted in the barrel first half and joined to an upper front grip with a front grip knob that slides in a front handle track. A front grip further includes a lower front grip joined to the upper front grip. The lower front grip further includes a plurality of front grip measurement markings. A rear handle is joined to the front grip with a pair of springs. A rear handle knob joins the rear handle to the barrel first half proximate a plurality of angle markings. The multi-colored barrel gauge, the plurality of front grip measurement markings, and the plurality of angle markings provide data to the user in selecting a properly fitting firearm.

In some embodiments, a plurality of barrel screws can join the first half to the barrel second half. A guide nut and a bore sight can be arranged between the barrel first half and the barrel second half. A front sight slot can extend across the barrel first half joined and the barrel second half. A rear sight slot can extend across the barrel first half joined and the barrel second half. A pair of arms can be joined to each other with a central pivot pin; at least one arm is joined to the rear handle with a rear pivot pin.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
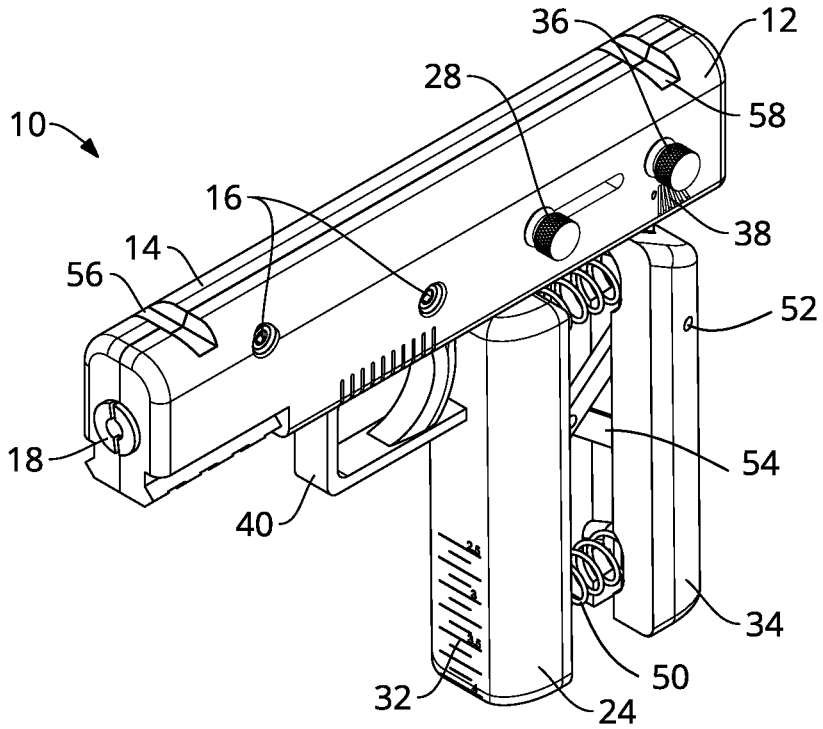
FIG. 1 shows a perspective view of one embodiment of the present invention.
Figure 2:
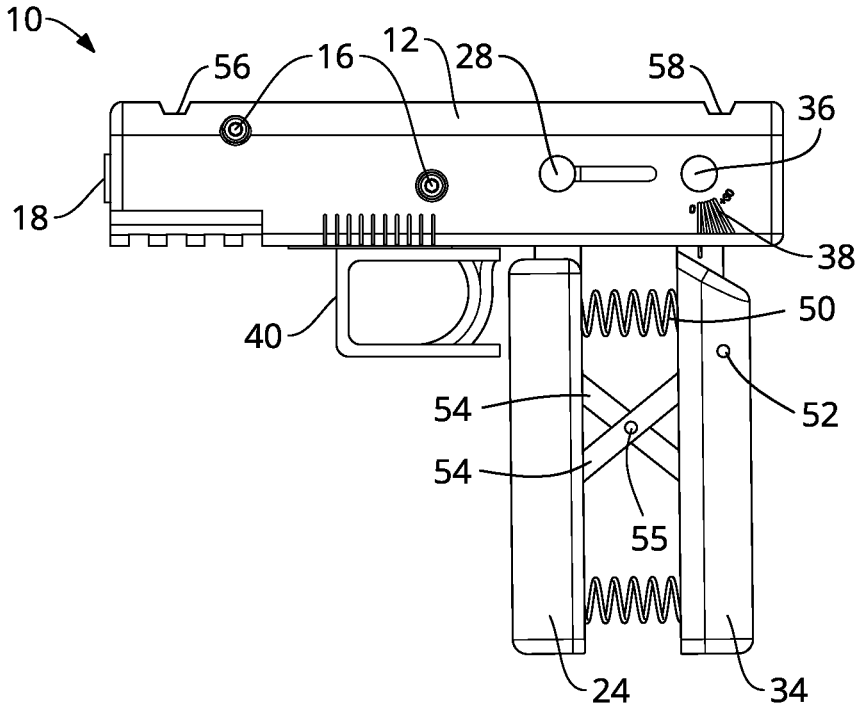
FIG. 2 shows a side view of one embodiment of the present invention.
Figure 3:
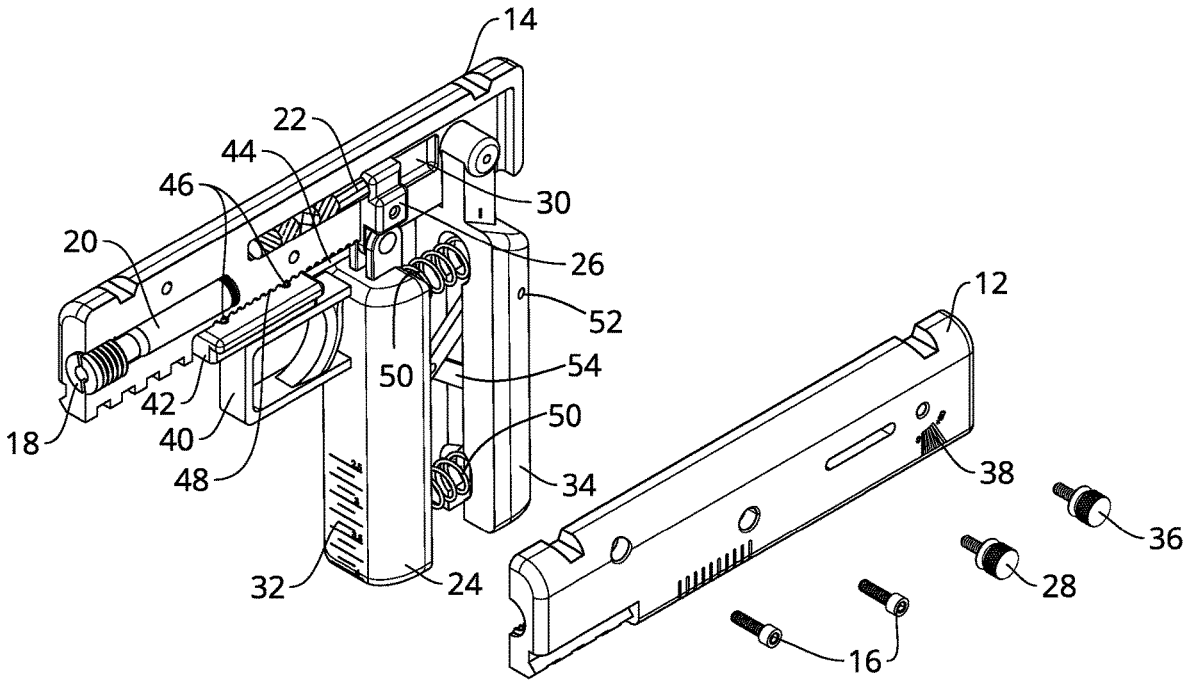
FIG. 3 shows a partial exploded view of one embodiment of the present invention.
Figure 4:
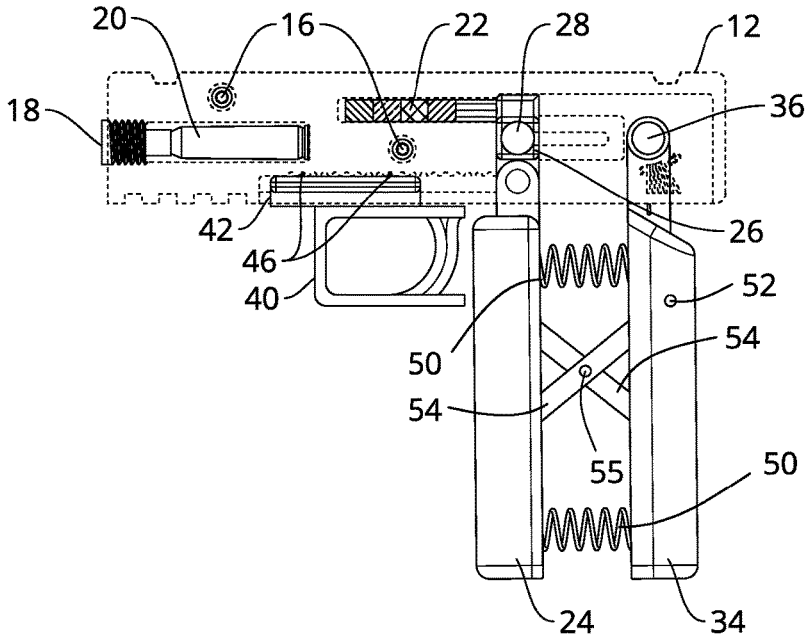
FIG. 4 shows a side view of one embodiment of the present invention.
Figure 5:
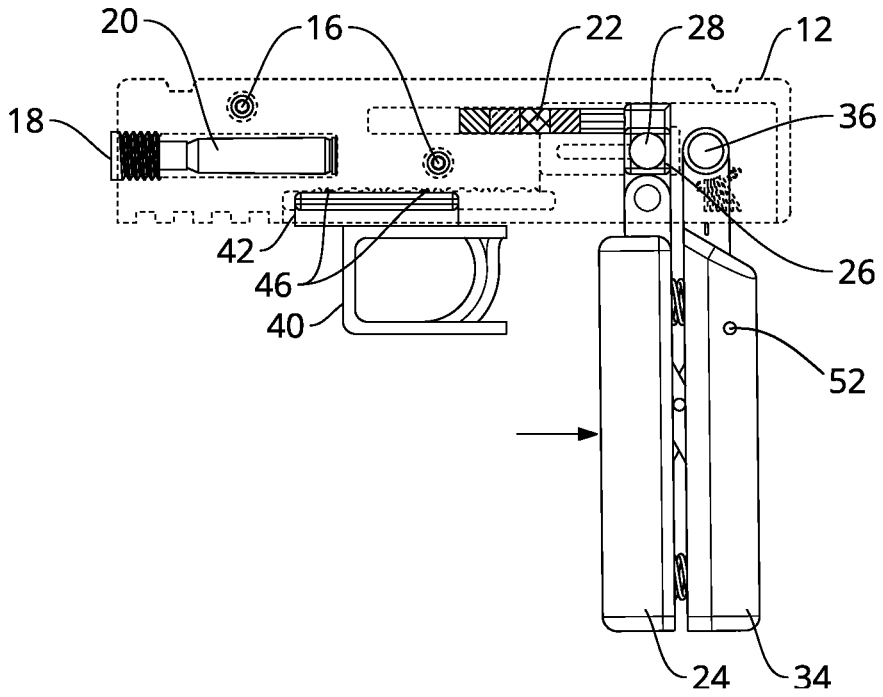
FIG. 5 shows a side view of one embodiment of the present invention.
Figure 6:
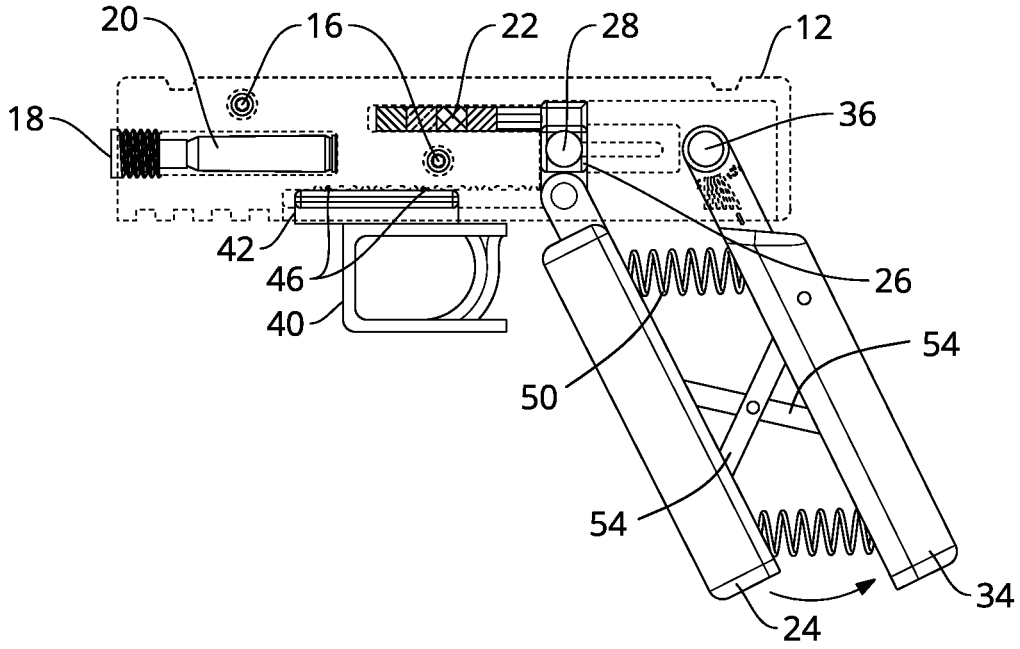
FIG. 6 shows a side view of one embodiment of the present invention.
Figure 7:
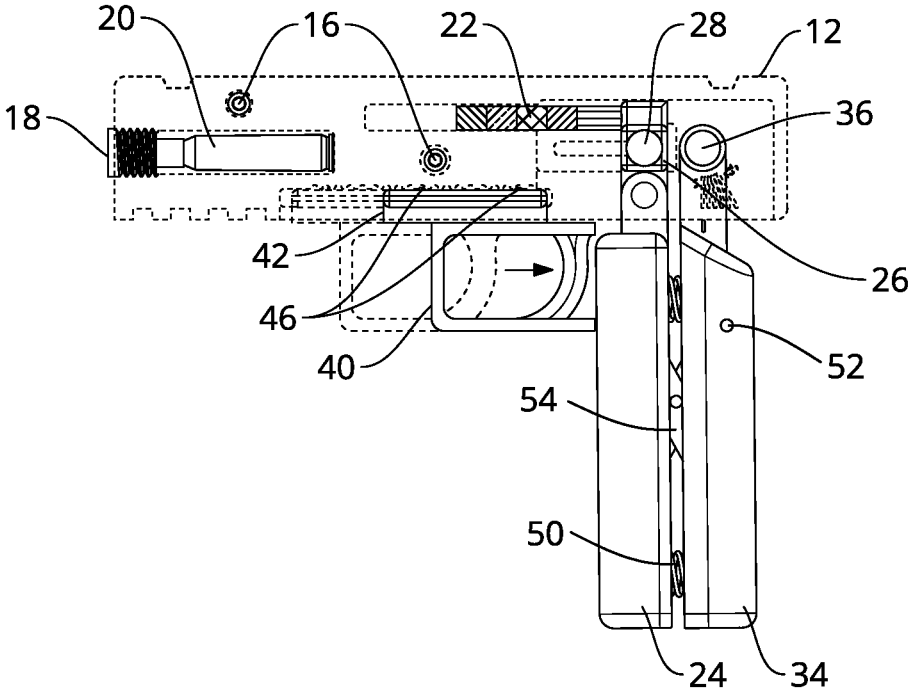
FIG. 7 shows a side view of one embodiment of the present invention.

By way of example, and referring to FIGS. 1-7, one embodiment of a grip measuring tool 10 comprises a barrel first half 12 joined to a barrel second half 14 with a plurality of barrel screws 16. A guide nut 18 and a bore sight 20 are arranged between the barrel first half 12 and the barrel second half 14. A front sight slot 56 extends across the barrel first half 12 joined and the barrel second half 14. A rear sight slot 58 extends across the barrel first half 12 joined and the barrel second half 14.

A multi-colored barrel gauge 22 is mounted in the first half 12. A front grip further comprises a lower front grip 24 joined to an upper front grip 26. The upper front grip 26 is joined to the multi-colored barrel gauge 22 with a front grip knob 28 that slides in a front handle track 30.

The lower front grip 24 further comprises a plurality of a plurality of front grip measurement markings 32. The front grip is joined to a rear handle 34 with a pair of springs 50. A pair of arms 54 are joined to each other with a central pivot pin 55. At least one arm 54 is joined to the rear handle 34 with a rear pivot pin 52. The rear handle 34 is attached to the barrel first half 12 with a rear handle knob 36 proximate angle markings 38 on the barrel first half 12.

The barrel second half 14 is joined to a trigger module 40 having a trigger module top plate 42. The trigger module top plate 42 slides on a top plate track 44 on the barrel second half 14. The top plate track further comprises a plurality of teeth 48 which can fit into a plurality of openings 46 in the trigger module top plate 42.

Figure 8:
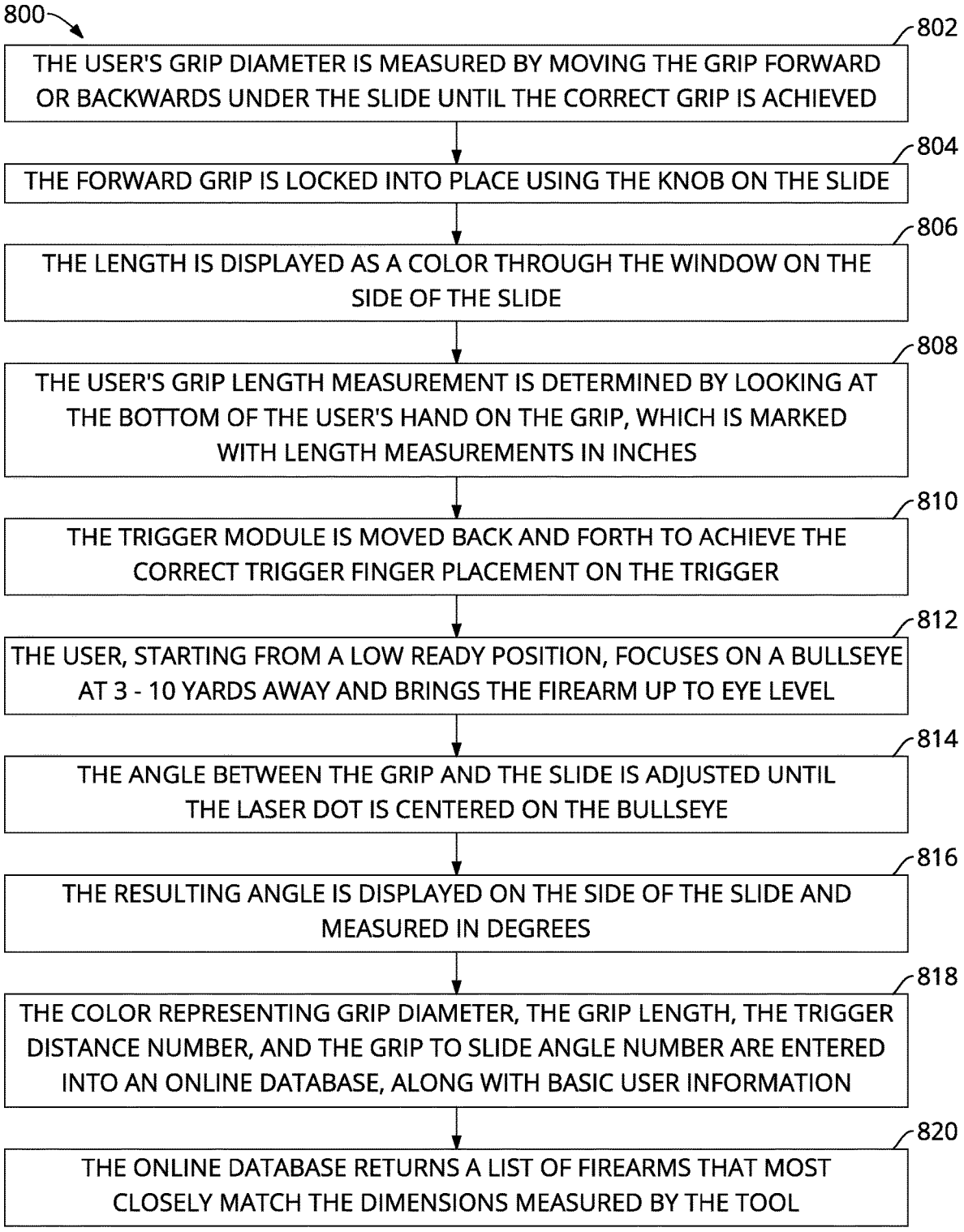
FIG. 8 shows a flow chart of one embodiment of the present invention.

Turning to FIG. 8, a process 800 for fitting a firearm to a user's hand involves the following steps which are not necessarily in order. First, at step 802, the user's grip diameter is measured by moving the grip forward or backwards under the slide until the correct grip is achieved. Then, at step 804, the forward grip is locked into place using the knob on the slide. Following that, at step 806, the length is displayed as a color through the window on the side of the slide. Subsequently, at step 808, the user's grip length measurement is determined by looking at the bottom of the user's hand on the grip, which is marked with length measurements in inches.

Next, at step 810, the trigger module is moved back and forth to achieve the correct trigger finger placement on the trigger. After that, at step 812, the user, starting from a low ready position, focuses on a bullseye at three to ten yards away and brings the firearm up to eye level. Then, at step 814, the angle between the grip and the slide is adjusted until the laser dot is centered on the bullseye. Following that, at step 816, the resulting angle is displayed on the side of the slide and measured in degrees. Subsequently, at step 818, the color representing grip diameter, the grip length, the trigger distance number, and the grip to slide angle number are entered into an online database, along with basic user information. Finally, at step 820, the online database returns a list of firearms that most closely matches the dimensions measured by the tool.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A grip measurement tool is configured to aid a user in selecting a properly fitting firearm; the grip measurement tool comprising:

a barrel first half joined to a barrel second half;

a multi-colored barrel gauge, mounted in the barrel first half and joined to an upper front grip with a front grip knob that slides in a front handle track;

a front grip further comprising a lower front grip joined to the upper front grip; wherein the lower front grip further comprises a plurality of front grip measurement markings;

a rear handle is joined to the front grip with a pair of springs;

a rear handle knob, joining the rear handle to the barrel first half proximate a plurality of angle markings;

wherein the multi-colored barrel gauge, the plurality of front grip measurement markings, and the plurality of angle markings provide data to the user in selecting a properly fitting firearm.

2. The grip measurement tool of claim 1, further comprising a plurality of barrel screws joining the first half to the barrel second half.

3. The grip measurement tool of claim 2, further comprising a guide nut and a bore sight, arranged between the barrel first half and the barrel second half.

4. The grip measurement tool of claim 3, further comprising a front sight slot extending across the barrel first half joined and the barrel second half.

5. The grip measurement tool of claim 4, further comprising a rear sight slot extending across the barrel first half joined and the barrel second half.

6. The grip measurement tool of claim 5, further comprising a pair of arms, joined to each other with a central pivot pin; at least one arm is joined to the rear handle with a rear pivot pin.

* * * * *